US005386902A

United States Patent [19]

Bointon et al.

[11] Patent Number: 5,386,902

[45] Date of Patent: Feb. 7, 1995

[54] COIN ROUTING GATE

[75] Inventors: Richard G. Bointon, Reading; Timothy P. Waite, Esher, both of United Kingdom

[73] Assignee: Mars Incorporated, McLean, Va.

[21] Appl. No.: 185,868

[22] PCT Filed: Jul. 30, 1992

[86] PCT No.: PCT/GB92/01413

§ 371 Date: Jan. 25, 1994

§ 102(e) Date: Jan. 25, 1994

[87] PCT Pub. No.: WO93/03459

PCT Pub. Date: Feb. 18, 1993

[30] Foreign Application Priority Data

Jul. 31, 1991 [GB] United Kingdom ..... 9116512

[51] Int. Cl.[6] ..... G07F 1/04

[52] U.S. Cl. ..... 194/346

[58] Field of Search ..... 194/344, 346; 251/129.15, 129.16

[56] References Cited

U.S. PATENT DOCUMENTS

| | | | |
|---|---|---|---|
| 1,282,275 | 10/1918 | Morris | 251/129.16 X |
| 3,109,528 | 11/1963 | Barnhart . | |
| 3,751,001 | 8/1973 | Rayment | 251/129.16 |
| 4,534,459 | 8/1985 | Plesko | 194/346 |
| 4,838,406 | 6/1989 | Levasseur . | |
| 5,167,314 | 12/1992 | Levasseur | 194/346 |

FOREIGN PATENT DOCUMENTS

| | | |
|---|---|---|
| 0017428 | 10/1980 | European Pat. Off. . |
| 0154525 | 9/1985 | European Pat. Off. . |
| 1060011 | 2/1967 | United Kingdom . |
| 1273163 | 5/1972 | United Kingdom . |
| 2088137 | 6/1982 | United Kingdom . |

OTHER PUBLICATIONS

M. Fiehl, "Pocket Selector for Short or Standard Cards," IBM Technical Disclosure Bulletin, vol. 2, No. 2, p. 1 (Aug. 1959).

*Primary Examiner*—Michael S. Huppert
*Assistant Examiner*—Scott L. Lowe
*Attorney, Agent, or Firm*—Davis Hoxie Faithfull & Hapgood

[57] ABSTRACT

A coin routing gate is formed by a solenoid, the armature of which is, or is directly coupled to, a resilient flexible member. Upon energization of the solenoid, the member is attracted to a yoke, and flexes during the course of its movement so that the path of movement is increased. The inherent resilience of the member shifts it back to its original position upon deenergization of the solenoid. The flexible member has a coin-directing surface, or is coupled to a coin-directing member.

22 Claims, 2 Drawing Sheets

COIN ROUTING GATE

FIELD OF THE INVENTION

This invention relates to coin routing gates commonly used in coin handling apparatus for directing a coin to a selected one of two or more paths.

BACKGROUND OF THE INVENTION

A number of different forms of gates are Known. Usually, the gates are operated by a solenoid which moves the gate between first and second positions upon actuation of the solenoid, the gate returning to its first position under the force of a spring when the solenoid is deactuated. The gate may for example be a pivoted flap which in one position is out of a coin path but which in the other position extends into the coin path to divert a coin in a direction perpendicular to its plane into another coin path. The gate may alternatively be movable linearly from a position out of a coin path to a position at which it blocks the coin path and thus forces coins to roll transversely into a different coin path. Examples of coin routing gates are shown in GB 1 582 691, EP-A-0 017 428 and GB-A-2 111 737.

In many circumstances it is desirable for the gate to consume only small amounts of power. Examples of arrangements which are designed to meet this requirement -are .disclosed in GB-A-2 133 601, EP-A-0 154 525 and EP-A-0 343 967.

SUMMARY OF THE INVENTION

The present invention is directed to a further arrangement intended to provide a gate which has low power requirements, and which is compact, inexpensive and capable of use in a variety of different configurations.

According to the present invention there is provided a coin routing gate comprising a solenoid having a member which is formed by or directly coupled to the solenoid armature and which is movable upon actuation and deactuation of the solenoid to reconfigure a coin path, characterized in that the member is flexible and is mounted so that actuation of the solenoid tends to flex the member as its moves, with an increasing angle of flexure along its length.

In the preferred embodiment, the flexible member has a coin-directing surface which in one position of the member is in the path of incoming coins so as to divert them to a selected route. The member is movable to a second position out of the coin path so that coins can travel without deflection into a second route. The flexible member is preferably made of plastics material, so that it is light and easy to move and therefore the solenoid requires little current despite the fact that the path of movement is large, due to the flexibility of the member. The armature may consist of a layer, e.g. of soft iron, laminated to the plastics member, or alternatively of discrete sections which are fixed to, and preferably embedded in, the member. The discrete sections may be so positioned that they do not interfere with the flexing of the member.

The flexible member preferably has one end which is fixed or substantially fixed, and a free end which moves upon actuation of the solenoid. Greater efficiency can be achieved by making the thickness of the member smaller towards the free end thereof.

BRIEF DESCRIPTION OF THE DRAWINGS

An arrangement embodying the invention will now be described by way of example with reference to the accompanying drawings, in which.

DETAILED DESCRIPTION

Figure 1:
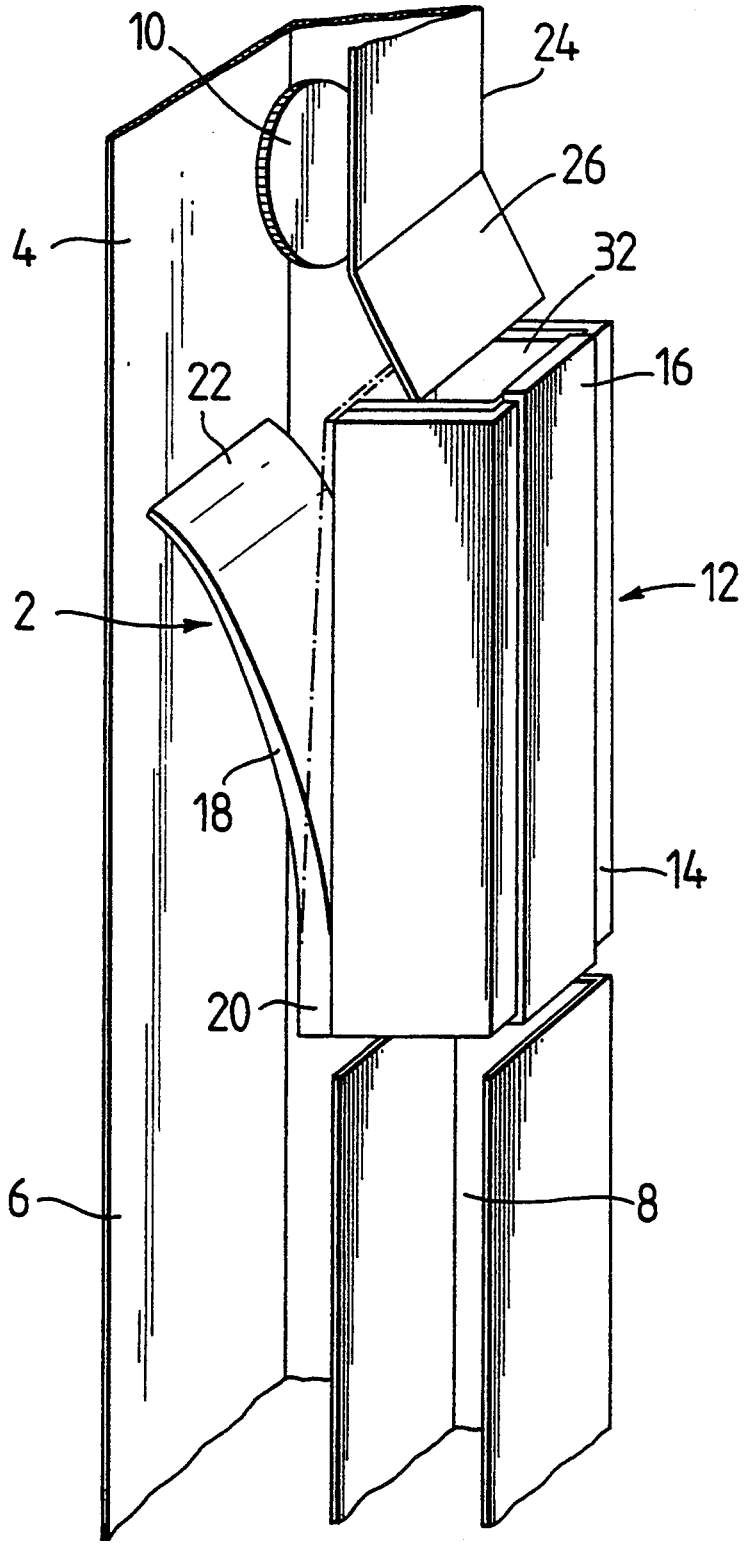
FIG. 1 is a schematic perspective view showing a coin routing gate according to the invention.

Referring to FIG. 1, a gate apparatus 2 is positioned at the junction between a first, entry coin path 4 and selectable exit coin paths 6 and 8. The gate apparatus 2 can be arranged to cause a coin such as that indicated at 10 to travel into a selected one of the exit paths 6 and 8. The gate apparatus 2 comprises a solenoid 12 which includes a yoke in the form of a U-section channel 14 of soft iron having a multi-turn coil schematically indicated at 16 wound around its base. An elongate flexible armature member 18 has a lower end 20 which extends across the open side of the channel 14, and an upper, free end 22. The flexible member 18 is resilient and is so formed that in its natural state it curls away from the channel 14 as shown in solid lines in FIG. 1 to extend into the path 4 so that it will deflect the coin 10 into the channel 14. The coin will travel through the channel 14 and out of its lower end, which is positioned immediately above the exit channel 8. A wall 24 of the coin path 4 is inclined as shown at 26 so as to increase the depth of the coin path 4 and ensure that there is sufficient room for the coin 10 to turn into the channel 14. For purposes of clarity, the depth of the coin paths as measured perpendicular to the plane of the coin is exaggerated.

The armature of the solenoid 12 is not shown in FIG. 1, but is fixed to and preferably embedded in the flexible member 18. Upon energisation of the coil 16, the armature is attracted toward the channel 14 and the member thus moves to the position shown in broken lines. This clears the coin path 4 so that the coin 10 can travel directly down into the path 6.

It will be appreciated that the free end 22 of the member 18 travels a substantial distance due to the fact that the member changes its configuration (in this case by becoming planar) due to its flexing as it moves towards the channel 14.

Upon de-energisation of the coil 16, the member 18 springs back to the position shown in solid lines due to its inherent resilience.

The gate is efficient and has low power requirements for a number of reasons. First, the flexing of the member 18 means that, as compared with a straight rigid member whose free end executes the same path of movement, the average distance between the yoke and the armature is substantially shorter and therefore the amount of effective flux is substantially greater due to the inverse square law of magnetic attraction. In effect, at each point during the movement of the member toward the yoke, the attraction between the yoke and the member is similar to the force in a conventional solenoid at the point of closing, which is the most efficient part of the movement. Second, there is no additional spring, so less force is required. Third, the use of plastics material to form the member can provide the necessary strength while maintaining a low weight, so that less energy is required to move the member.

During the course of the movement of the member, the member comes to abut the open end of the channel 14 at positions which gradually shift toward the free end 22 of the member. The amount of magnetic flux shorted by the portion of the member 18 abutting the channel therefore gradually increases, so that the remaining amount of flux available for attracting the parts of the member which are close to but not abutting the channel decreases. This is mitigated by selecting the materials of the member such that magnetic flux saturation occurs in the closed part of the member. As further compensation for this, the thickness of the member 18 (as measured in the direction of movement) diminishes progressively and preferably continuously along the length of the member (i.e. in a direction transverse to the substantially horizontal axis about which the member flexes and transverse to the path of movement of the member 18) toward the free end 22, so that the force required to flex the member decreases. This also compensates for the fact that the area of the member 18 which is spaced from the yoke and therefore over which the effective attraction is operating decreases during the course of the movement of the member 18 toward the yoke.

Figure 2A:
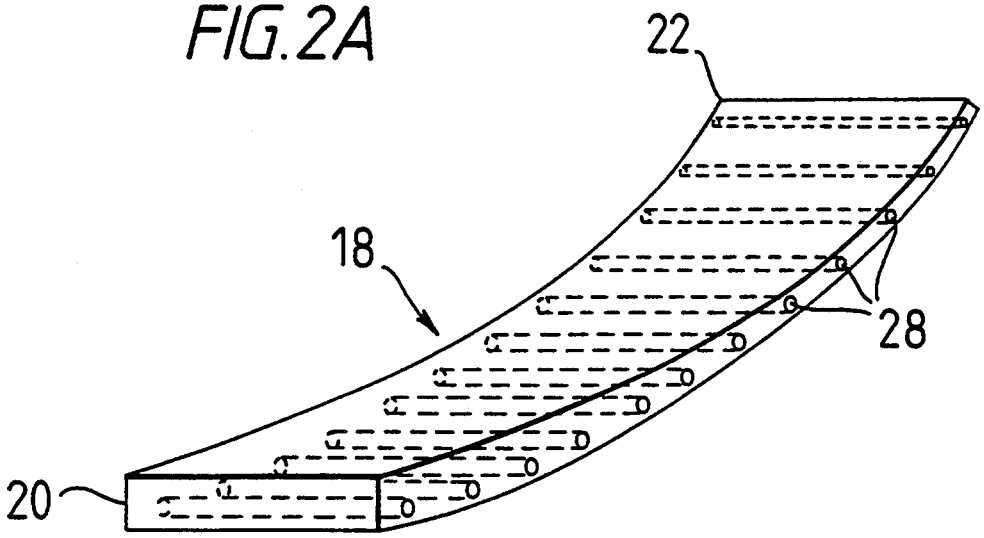
FIGS. 2A and 2B show different versions of the flexible member of the gate of FIG. 1.

As shown in FIG. 2A, the member 18 may consist of a moulded plastics body having embedded therein elongate soft iron rods or strips of foil such as those shown at 28. These are spaced in succession along the length of the member 18, i.e. in a direction transverse to the axis about which flexing occurs, so as not to interfere with the flexing.

Figure 2B:
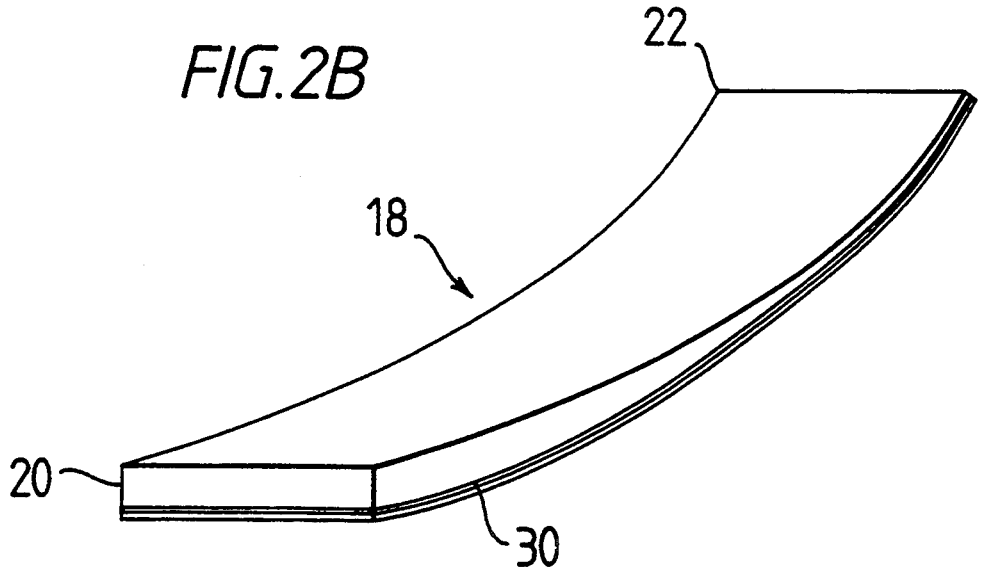

As shown in FIG. 2B, the member 18 may alternatively consist of a plastics body having laminated thereto or therein a soft-iron layer 30.

In either arrangement, it is preferred that the soft iron be disposed close to the surface of the member which is closest to the yoke.

The channel 14 preferably has a plastics liner 32 on its inside surface covering the coil 16 to facilitate the passage of coins therethrough.

In the embodiment described above, the flexible member 18 tends to straighten as it moves toward the yoke, but alternatively the arrangement may be such that the member tends to straighten when it is released by the yoke.

Although, in the above arrangement, the coin-directing surface of the gate is a surface of the member 18, this is not essential. Instead, the free end 22 of the member could be coupled to a separate routing member which is arranged selectively to divert coins.

We claim:

1. A coin routing gate comprising a solenoid having a solenoid armature which is integral with a member which is movable upon actuation and deactuation of the solenoid to reconfigure a coin path, wherein the member is flexible and is mounted so that actuation of the solenoid tends to flex the member as it moves, with an increasing angle of flexure along its length.

2. A gate as claimed in claim 1, wherein the member is resilient.

3. A gate as claimed in claim 2, wherein a return force causing the member to move back to its original position on deactuation of the solenoid is produced by the resilience of the member.

4. A gate as claimed in claim 1, wherein the member has opposite ends, one of which is substantially fixed and the other which is free to move upon actuation of the solenoid.

5. A gate as claimed in claim 4, wherein a thickness of the member as measured in the direction of movement progressively decreases toward the free end of the member.

6. A gate as claimed in claim 1, wherein the flexible member is made of plastics material.

7. A gate as claimed in claim 1, wherein the armature comprises discrete sections coupled to the member at positions disposed in succession along a direction which is transverse to a path of movement of the member and transverse to an axis about which the member flexes.

8. A gate as claimed in claim 1, wherein the solenoid armature comprises a layer laminated to the flexible member.

9. A gate as claimed in claim 1, wherein the armature is embedded in the flexible member.

10. A gate as claimed in claim 1, wherein the solenoid comprises a channel-shaped yoke having an open side which is closed by the flexible member upon actuation of the solenoid.

11. A gate as claimed in claim 10, wherein the coin path extends through the yoke when the solenoid is deactuated.

12. A coin routing gate comprising a solenoid having a solenoid armature which is directly coupled to a member which is movable upon actuation and deactuation of the solenoid to reconfigure a coin path, wherein the member is flexible and is mounted so that actuation of the solenoid tends to flex the member as it moves, with an increasing angle of flexure along its length.

13. A gate as claimed in claim 12, wherein the member is resilient.

14. A gate as claimed in claim 13, wherein a return force causing the member to move back to its original position on deactuation of the solenoid is produced by the resilience of the member.

15. A gate as claimed in claim 12, wherein the member has opposite ends, one of which is substantially fixed and the other which is free to move upon actuation of the solenoid.

16. A gate as claimed in claim 15, wherein a thickness of the member as measured in the direction of movement progressively decreases toward the free end of the member.

17. A gate as claimed in claim 12, wherein the flexible member is made of plastics material.

18. A gate as claimed in claim 12, wherein the armature comprises discrete sections coupled to the member at positions disposed in succession along a direction which is transverse to a path of movement of the member and transverse to an axis about which the member flexes.

19. A gate as claimed in claim 12, wherein the solenoid armature comprises a layer laminated to the flexible member.

20. A gate as claimed in claim 12, wherein the armature is embedded in the flexible member.

21. A gate as claimed in claim 12, wherein the solenoid comprises a channel-shaped yoke having an open side which is closed by the flexible member upon actuation of the solenoid.

22. A gate as claimed in claim 21, wherein the coin path extends through the yoke when the solenoid is deactuated.

* * * * *